United States Patent [19]

Dean

[11] 3,937,506

[45] Feb. 10, 1976

[54] DOOR SECURITY PIN

[76] Inventor: Joe O. Dean, 5841 NE. 22nd Ave., Fort Lauderdale, Fla. 33308

[22] Filed: Sept. 19, 1974

[21] Appl. No.: 507,441

[52] U.S. Cl. ..... 292/300; 85/9 R; 16/137

[51] Int. Cl.[2] ..... E05C 19/18

[58] Field of Search ..... 85/1 SS, 14, 42; 292/300, 292/251, 251.5; 16/137

[56] References Cited

UNITED STATES PATENTS

| | | | |
|---|---|---|---|
| 1,412,875 | 4/1922 | Knuth | 16/137 |
| 1,651,320 | 11/1927 | Brugmann | 292/300 |
| 2,770,276 | 11/1956 | Broder | 85/1 SS |
| 3,003,802 | 10/1961 | Wilson | 292/251.5 |
| 3,405,595 | 10/1968 | Peterson | 292/300 |

FOREIGN PATENTS OR APPLICATIONS

| | | | |
|---|---|---|---|
| 1,366,095 | 6/1964 | France | 85/42 |

*Primary Examiner*—Richard E. Moore
*Attorney, Agent, or Firm*—Brady, O'Boyle & Gates

[57] ABSTRACT

A security pin for installation between a door jamb and a door to prevent unauthorized entry through the door, when locked, by removal of the door hinge pins.

6 Claims, 7 Drawing Figures

DOOR SECURITY PIN

BACKGROUND OF THE INVENTION

Building codes require entrance door to swing outwardly for occupant safety in the event of fire, or other emergencies requiring an expeditious egress from the building. In order that these doors can be swung outwardly, it is necesssary that the door hinge pins be disposed on the side of the door facing the outside. As a result, the hinge pins are accessible from the outside and can be easily removed, whereby the unauthorized removal of the door, even when locked, can be easily accomplished.

In order to prevent the unauthorized removal of locked, outside-opening door, it has been proposed to provide pins between the door jamb and the edge of the door. Such an arrangement is disclosed in U.S. Pat. Nos. 1,391,304 to Dowling dated Sept. 20, 1921; and 2,797,432 to Gakle dated July 2, 1957.

The door security pin of the present invention is an improvement over the security pins employed heretofore, in that the instant security pin is constructed and arranged to be installed on existing doors by a person, relatively unskilled in carpentry, such as the do-it-yourself homeowner. The security pin of the present invention includes a threaded portion adapted to be inserted into the door jamb, a body portion having polygonal faces adapted to be engaged by a suitable tool for turning the threaded portion into the door jamb, a shoulder between the body portion and the threaded portion to limit the insertion of the pin into the door jamb, and an impression portion on the end of the body portion for forming an indentation in the edge of the door for aligning the longitudinal axis of the pin with the hole to be drilled in the edge of the door. A bushing is also provided for insertion into the drilled hole in the edge of the door and adapted to receive the body portion of the pin.

Figure 1:
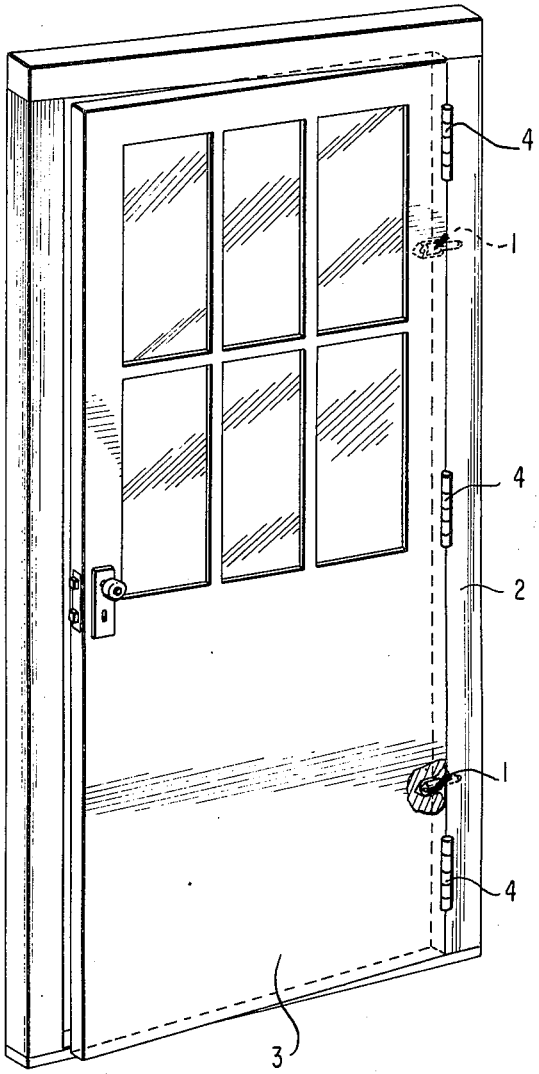
FIG. 1 is a perspective view of an outside-opening type door with the security pins of the present invention mounted in operative position between the door jamb and the edge of the door.

Referring to the drawings, and more particularly to FIG. 1 thereof, the security pins of the present invention designated generally by reference numeral 1, are adapted to be mounted between a door jamb 2 and the edge of a door 3 pivotally connected to the jamb by hinges 4. The door, being an outwardly swinging type, has the hinges and the associated hinge pins disposed on the side of the door facing the outside. It is well known that these types of doors, without the security pins, can be readily unhinged by removing the hinge pins from the hinges, whereby access to the locked building may be obtained. By employing security pins, the normal opening and closing of the door is not impeded, and if the hinge pins should be removed in an attempt to open a locked door, the security pins retain the inner edge of the door in the locked position.

Figure 2A:
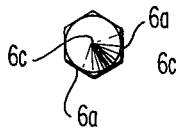
FIG. 2*a* is an end view taken along line 2*a*—2*a* of FIG. 2.
Figure 2:
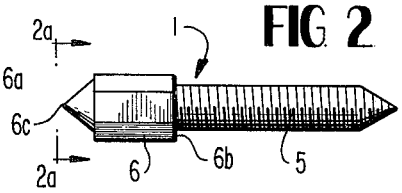
FIG. 2 is a side elevational view of one embodiment of the security pin of the present invention.

The details of the construction of one embodiment of the security pin of the present invention is shown in FIGS. 2 and 2*a* and comprises a threaded portion 5, a body portion 6 having polygonal faces 6*a* adapted to be engaged by a suitable tool for turning the threaded portion into the door jamb 2. The threaded portion is of a reduced diameter as compared to the body portion to thereby form a shoulder 6*b* for limiting the insertion of the pin into the door jamb, and the free end of the body portion is pointed as at 6*c* to provide an impression portion whereby an indentation can be formed in the edge of the door for aligning the longitudinal axis of the pin with the hole to be drilled into the edge of the door when installing the security pins, to be described more fully hereinafter.

Figure 3A:
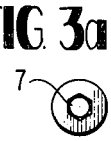
FIG. 3*a* is an end view taken along line 3*a*—3*a* of FIG. 3.
Figure 3:
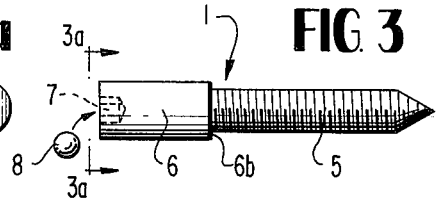
FIG. 3 is a side elevational view of another embodiment of the security pin of the present invention.

Another embodiment of the security pin is shown in FIGS. 3 and 3*a* wherein the polygonal faces 7 are formed interiorly of the body portion 6, rather than on the external surface thereof as in the embodiment of FIG. 2, to thereby form a socket for receiving the end of an Allen wrench whereby the pin can be threaded into the door jamb. The impression portion of the pin is provided by a small magnetic ball adapted to be inserted into the socket 7 and having a portion protruding therefrom for engaging the edge of the door to form an indentation therein.

Figure 4:
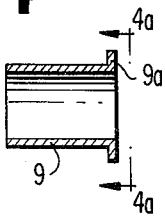
FIG. 4 is a side elevational view of a bushing adapted to be inserted into a bore drilled in the edge of the door.
Figure 4A:
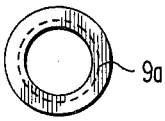
FIG. 4*a* is a view taken along line 4*a*—4*a* of FIG. 4.

Referring to FIGS. 4 and 4*a*, a cylindrical bushing 9 having a flange portion 9*a* is provided for insertion into the hole drilled into the door edge to reinforce the hole.

To install the security pins of the present invention, with the door in the open position, the pins are threaded into the hinge side of the door jamb by means of a suitable wrench until the shoulder 6*b* abuts the face of the door jamb. The door is then moved toward the closed position until the point 6*c* or ball 8 forms an impression in the door edge to thereby locate the longitudinal axis of the security pin. A hole is then drilled at the impression point and a bushing 9 is inserted therein. When the door is moved to the fully closed position, the body portion 6 of each security pin will enter the cylindrical bushing 9.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A security pin installed between the hinge side of a door jamb and a door edge, comprising a threaded portion inserted into the door jamb, a body portion integrally connected to the threaded portion, said threaded portion being of a reduced diameter to thereby form a shoulder between the body portion and the threaded portion for limiting the insertion of the pin into the door jamb, polygonal surfaces provided on said body portion adapted to be engaged by a suitable tool to facilitate the insertion of the threaded portion of the pin into the door jamb, and a pointed portion on the free end of the body portion for forming an indentation in the edge of the door to thereby facilitate the alignment of the longitudinal axis of the pin with a hole to be formed in the edge of the door at the point of indentation, a hole formed in the edge of the door, said hole being positioned in alignment with the pointed end of the pin, whereby during the normal opening and closing of the door, the body portion of the pin is respectively removed from and inserted into the hole.

2. A security pin for installation between the hinge side of a door jamb and a door edge, comprising a threaded portion adapted to be inserted into the door jamb, a body portion integrally connected to the threaded portion, said threaded portion being of a reduced diameter to thereby form a shoulder between the body portion and the threaded portion for limiting the insertion of the pin into the door jamb, polygonal surfaces provided on said body portion adapted to be engaged by a suitable tool to facilitate the insertion of the threaded portion of the pin into the door jamb, an impression portion on the free end of the body portion for forming an indentation in the edge of the door to thereby facilitate the alignment of the longitudinal axis of the pin with a hole to be formed in the edge of the door at the point of indentation; said impression portion comprising a socket formed in the free end of the body portion and a ball removably mounted in said socket; and a hole formed in the edge of the door, said hole being positioned in alignment with the free end of the pin, whereby during the normal opening and closing of the door, the body portion of the pin is respectively removed from and inserted into the hole.

3. A security pin according to claim 1, wherein the polygonal surfaces are provided on the outer surface of the body portion.

4. A security pin according to claim 2, wherein the polygonal surfaces are provided in the socket formed interiorly of the body portion.

5. A security pin according to claim 1, wherein a bushing is inserted within the hole formed in the door edge for receiving the body portion of the pin.

6. A security pin according to claim 2, wherein a bushing is inserted within the hole formed in the door edge for receiving the body portion of the pin.

* * * * *